United States Patent [19]

Carr et al.

[11] Patent Number: 4,686,498

[45] Date of Patent: Aug. 11, 1987

[54] COAXIAL CONNECTOR

[75] Inventors: Kenneth Carr, Harvard; Arthur A. Blaisdell, Ashland, both of Mass.

[73] Assignee: M/A-COM, Inc., Burlington, Mass.

[21] Appl. No.: 723,304

[22] Filed: Apr. 15, 1985

[51] Int. Cl.[4] ..... H01P 1/04

[52] U.S. Cl. ..... 333/260; 333/26; 333/255

[58] Field of Search ..... 333/26, 33, 254≧257, 333/260, 261

[56] References Cited

U.S. PATENT DOCUMENTS

| | | | |
|---|---|---|---|
| 2,643,139 | 6/1953 | Hamilton | 333/255 X |
| 2,922,970 | 1/1960 | Reed | 333/33 |
| 3,076,948 | 2/1963 | Misner | 333/255 |
| 3,087,129 | 4/1963 | Maury et al. | 333/260 |
| 4,052,683 | 10/1977 | Van Heuven et al. | 333/26 X |

*Primary Examiner*—Paul Gensler

*Attorney, Agent, or Firm*—Wolf, Greenfield & Sacks

[57] ABSTRACT

A coaxial connector having a pair of members, each of substantially the same construction, and each including means at an outer side thereof for receiving a first coax cable and means at an inner side thereof defining a section of waveguide. In each member there is a transition means that intercouples the coax cable and the section of waveguide. The pair of members are supported together by a support means and there is further provided alignment means for holding the sections of waveguide in alignment.

17 Claims, 12 Drawing Figures

Fig.1
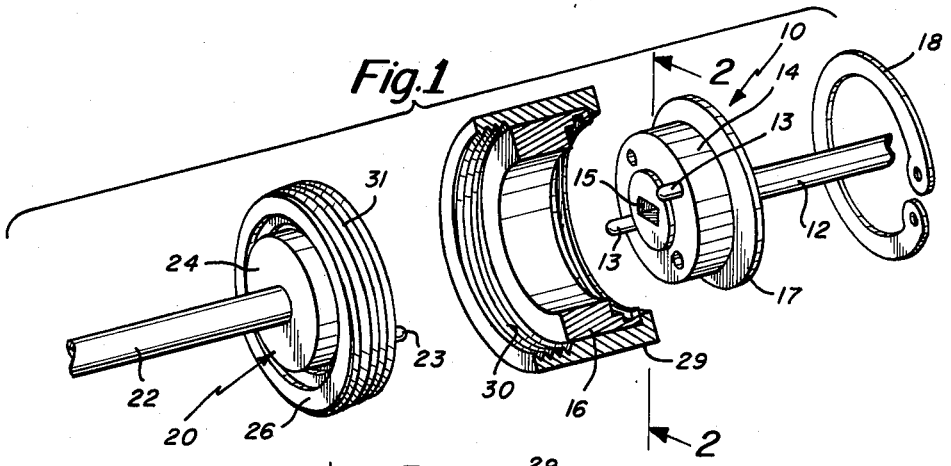
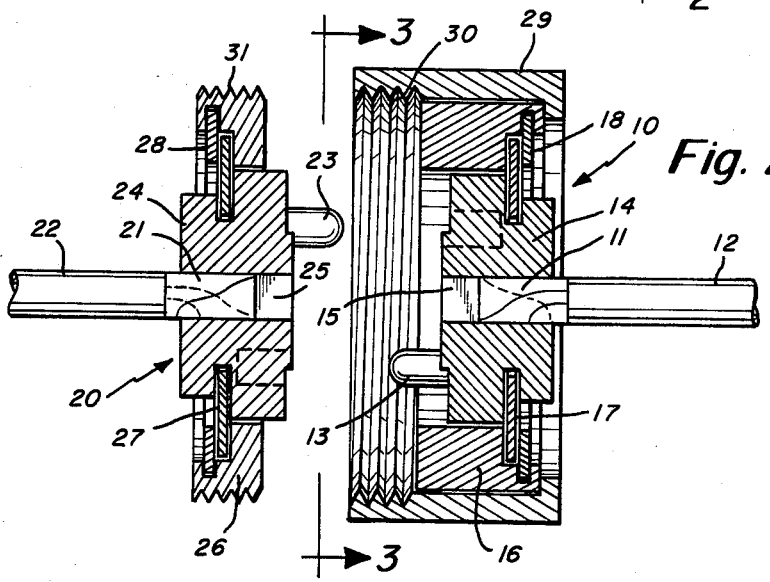
Fig. 2
Fig. 3
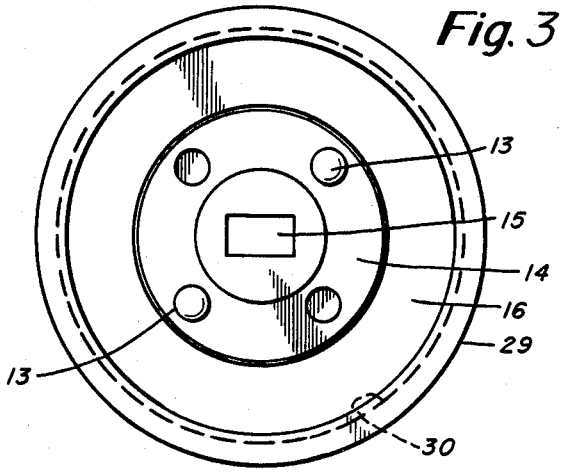

COAXIAL CONNECTOR

BACKGROUND OF THE INVENTION

The present invention relates in general to a coaxial connector. More particularly, the invention pertains to a millimeter wave connector that is particularly adapted for high frequency applications including frequencies above 40 GHz up to and including frequencies even as high as 140 GHz.

At frequencies above 40 GHz, there is no satisfactory coaxial connector that is available, particularly one that permits quick and accurate interconnection of different components or circuit elements using a flexible or semi-rigid cable, such as a standard coaxial cable. The well-known SSMA connector is the smallest acceptable connector available at the present time. The SSMA connector has dimensions which allow energy to propagate in a non-TEM mode at frequencies above 38 GHz. Thus, this connector is generally only effective in use at frequencies up to 38 GHz maximum. The propagation in a non-TEM mode at frequencies above 38 GHz introduces significant reduction in the accuracy and reliability of such a connector when used above this frequency.

In general, in order to operate at higher frequencies, it is necessary to reduce the coaxial conductor dimensions and/or the effective dielectric constant of the dielectric support in the cable. As the coaxial conductor dimensions are reduced, serious mechanical problems of fragility, alignment and tolerances are encountered, which eventually become so severe that the standard coaxial connector approach is no longer effective and has to be abandoned.

The aforementioned series of SSMA coaxial connectors is currently the only coaxial connector series with an associated military specification (MIL-C-39012). In its military standard configuration, it can be used without higher order mode problems as indicated previously, only up to a maximum frequency of 38 GHz. With some minor modifications to the connector, it can be used up to 40 GHz without moding problems. At 40 GHz, the SSMA connector is generally rated for a maximum VSWR of 1.47 at a maximum dissipative loss of 0.25 dB performance which is not acceptable for the measurement accuracy one realistically expects. At higher frequencies not only do the problems of mechanical fragility, alignment, and tolerance become more and more serious, but the VSWR and loss problems are further compounded.

Accordingly, it is an object of the present invention to provide an improved coaxial cable connector particularly usable at millimeter wave frequencies at least in a range from 18 GHz up to 110 GHz.

Another object of the present invention is to provide an improved coaxial connector that can be made very conveniently in relatively small sizes for high frequency applications.

Still another object of the present invention is to provide an improved coaxial cable connector that provides for quick, simple, and accurate connection and disconnection thereof.

Another object of the present invention is to provide an improved millimeter wave coaxial connector that is characterized by improved VSWR and improved dissipative loss, particularly at frequencies above 38 GHz.

Still another object of the present invention is to provide an improved millimeter wave coaxial connector that is a sex-less connector.

SUMMARY OF THE INVENTION

To accomplish the foregoing and other objects, features and advantages of the invention, there is provided a coaxial connector which is comprised of a first member including means at an outer side thereof for receiving a first transmission line means which may be a coax or other TEM transmission line. The first member also includes means it an inner side thereof defining a section of waveguide along with transition means disposed intermediate the first transmission line means and the section of waveguide. Similarly, there is a second member which also includes means at an outer side thereof for receiving a second transmission line means. This second transmission line means may also comprise a coax or other TEM transmission line. The second member also includes means at an inner side thereof defining a section of waveguide along with transition means disposed intermediate the second transmission line means and the second member section of waveguide. Means are provided for supporting the first and second members with the inner sides thereof in facing relationship further including means for holding the sections of waveguide of the first and second members, respectively, in alignment. In accordance with one embodiment of the invention, the sections of waveguide are each rectangular waveguide. In order to reduce the physical dimensions of the waveguide and, in turn, the overall connector, the waveguide may be dielectrically filled. This is particularly important at the lower millimeter wave frequencies such as in the range of 26–40 GHz. In an alternate embodiment in accordance with the invention, the bandwidth may be further expanded by utilizing a single or double-ridged waveguide rather than the rectangular waveguide. This, in turn, results in a reduced size connector and increases bandwidth when compared with normal rectangular waveguide. The aforementioned transition means comprises a waveguide-to-coax transition. Each transition may more particularly comprise an E-plane substrate having an etched circuit for providing a first transition from waveguide to antipodal finline. There may also be provided a second transition from antipodal finline to coaxial cable which comprises a microstrip circuit. The means for supporting referred to previously may comprise a retaining adapter to secure the first and second members together. The means for holding in alignment may comprise pin means associated with the members.

BRIEF DESCRIPTION OF THE DRAWINGS

Numerous other objects, features and advantages of the invention should now become apparent upon a reading of the following detailed description taken in conjunction with the accompanying drawing, in which:

FIG. 1 is a perspective view of a first embodiment of a coaxial connector constructed in accordance with the principles of the present invention;

FIG. 2 is a longitudinal cross-sectional view through the connector of FIG. 1;

FIG. 3 is a cross-sectional view taken along line 3—3 of FIG. 2;

DETAILED DESCRIPTION

Figure 4:
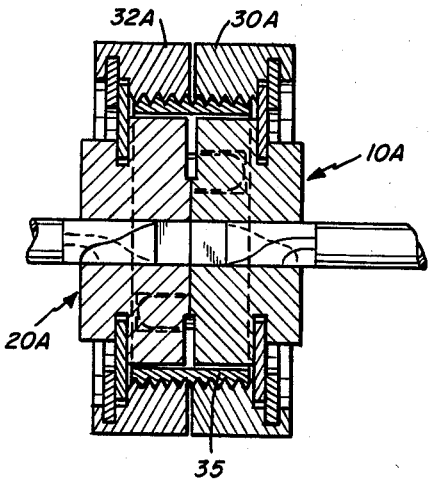
FIG. 4 is a cross-sectional view similar to the view of FIG. 2 and showing a different form of intercoupling connector members.
Figure 5:
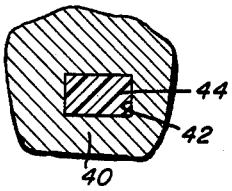
FIG. 5 is a fragmentary cross-sectional view showing an alternate embodiment in which the section of waveguide is dielectrically filled.
Figure 6:
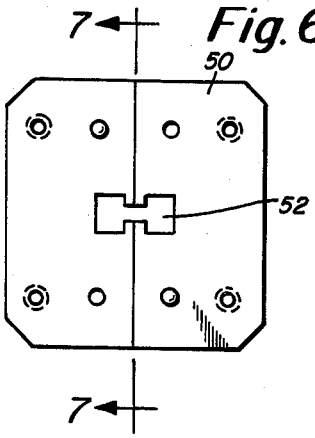
FIG. 6 illustrates a third embodiment of the present invention employing a double-ridge waveguide in the connector.
Figure 7:
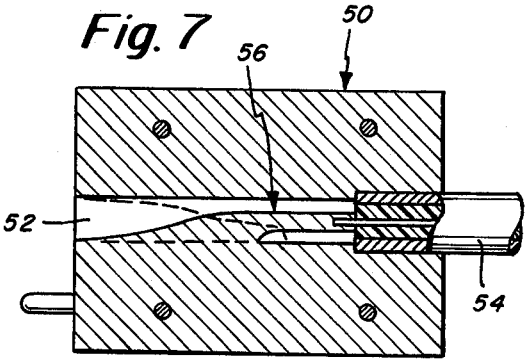
FIG. 7 is a further view taken along line 7—7 of FIG. 6 further illustrating the antipodal finline construction.
Figure 8:
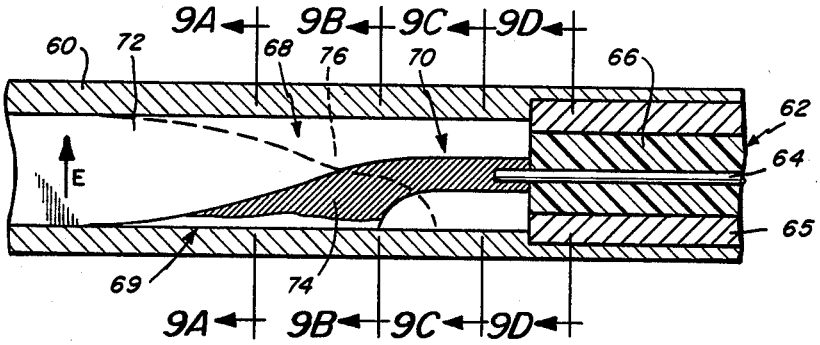
FIG. 8 is an enlarged fragmentary cross-sectional view showing specific detail of the coax-to-waveguide transition such as referred to in FIGS. 2, 4, and 7.

There is described herein an improved connector which is particularly adapted for use as a coaxial line connector. The principles of the invention are particularly adapted for millimeter wave connectors for frequency applications in the range of 18 GHz up to 110 GHz or possibly higher. A first embodiment of the connector is illustrated in FIGS. 1-3. FIG. 4 shows a similar connector construction but with a slightly different connector part intercoupling arrangement. FIG. 5 illustrates a slightly alternate embodiment employing a dielectrically filled waveguide. FIGS. 6 and 7 illustrate still a further embodiment in which the waveguide is of double-ridge form. FIG. 8 is a fragmentary enlarged cross-sectional view illustrating the waveguide-to-coax antipodal finline transition. FIGS. 9A-9D illustrate successive cross-sectional views taken across the transition.

In accordance with the present invention there are provided two separate connector members which may be of substantially the same construction. Each of these members is adapted to receive a coaxial line and is provided with a section of waveguide with the sections of waveguide of each member being adapted to be brought into abutting facing relationship. The final basic element of the combination is a transition means which enables transition between the coax and waveguide members.

In accordance with a first embodiment of the invention illustrated in FIGS. 1-3, the connector comprises a first member 10 for supporting the coax line 12 and a second member 20 for supporting the coax line 22. The member 10 basically comprises a dielectric support piece 14 and a support sleeve 16. Intermediate the dielectric support piece 14 and the support sleeve 16, there is provided a locating ring 17. There is also provided a retaining ring 18 for maintaining the piece 14 and the sleeve 16 together. Similarly, the member 20 comprises a dielectric support piece 24 and a support sleeve 26. A locating ring 27 is used to properly position the dielectric support piece 24 relative to the support sleeve 26. There is also provided a retaining ring 28 for holding the dielectric support piece 24 and the support sleeve 26 together.

The dielectric support piece 14 supports a waveguide section 15 having mounted therein an E-plane substrate 11 which includes an etched circuit (antipodal finline) that provides a transition from the waveguide 15 to coax. The specific transition construction is referred to hereafter in FIG. 8.

Similarly, with regard to the member 20 and in particular the dielectric support piece 24, there is supported therein a waveguide 25. The waveguide 25 has mounted therein an E-plane substrate 21 which includes an etched circuit (antipodal finline) that provides a transition from the waveguide to coax. Again, reference is made to specific construction in FIG. 8.

As illustrated in FIGS. 1-3, there is also provided a retaining nut 29 which has a threaded end 30 (internally threaded) which in turn engages with external threads 31 associated with member 20. The retaining nut 29 is used to cause a joining of the two members, 10 and 20. In order to provide proper alignment between the sections of waveguide 15 and 25, there are provided aligning pins 13 and 23 associated, respectively, with dielectric support pieces 14 and 24. The pieces 14 and 24 also have accommodating holes for the aligning pins 13 and 23 as indicated in dotted outline in FIG. 2.

Thus, in accordance with the present invention, there is provided for, in each of the members 10 and 20, a transition from coax to waveguide such as between the coax 12 and the waveguide section 15. This transition illustrated at 11 and 21 in FIG. 2 includes a transition from waveguide via antipodal finline to a microstrip circuit. The coaxial cable is then attached directly to the microstrip circuit. The transitions are scalable so as to operate over a full waveguide bandwidth from WR-42 to WR-10 waveguide sizes which cover the frequency range from 18 GHz up to 110 GHz. Bilateral measurements have been taken with the connector of this invention. These measurements indicate that there is operation with a VSWR less than 1.1 up to 140 GHz which is the practical limit for the use of microstrip.

FIG. 4 illustrates an alternate embodiment of the invention. In FIG. 4, the basic members 10A and 20A are substantially the same as the members 10 and 20 illustrated in FIGS. 1-3. The primary difference in FIG. 4 is the means of intercoupling the members 10A and 20A. In this connection it is noted that each of the members 10A and 20A include threaded retaining sleeves 30A and 32A, respectively. There is also provided an externally threaded bushing 35 that intercouples the threaded sleeves 30A and 32A. As far as the members 10A and 20A are concerned, they are the same as illustrated previously including waveguide sections, a transition section and means for receiving the coax line. FIG. 4 also clearly illustrates the alignment that is readily obtained at the abutting waveguide sections. The alignment pins and associated holes are shown in dotted in FIG. 4.

FIG. 5 illustrates an alternate embodiment of the invention and in particular illustrates a connector member 40 having a section of waveguide 42 which is dielectrically filled as indicated at 44. The waveguide is dielectrically filled to reduce the physical dimensions of the waveguide and, in turn, the overall connector size. This is particularly important at the lower millimeter wave frequencies, such as in the range of 26-40 GHz. In this connection, the normal waveguide size (K, a-band) inside dimensions are 0.280"×0.140". A dielectrically-filled waveguide using, for example, fused silica results in an approximate waveguide dimension of 0.140"×0.170". The use of dielectric loading also facilitates low loss hermetic sealing if desired.

The bandwidth of the device may be further broadened by utilizing a similar structure as illustrated in FIGS. 1–3 but substituting for the rectangular waveguide described therein, a ridged waveguide. This is illustrated in FIGS. 6 and 7. Therein there is described a connector member 50 having a ridged waveguide section 52. In the particular example in FIG. 6 this is a double-ridged waveguide, although a single-ridged waveguide could also be employed. This change to a double-ridged waveguide in comparison with a rectangular waveguide will further result in reduced size of the device.

FIG. 7 illustrates the coaxial cable 54 retained by the member 50 and also shows the antipodal finline at 56 transitioning to the waveguide end at 52.

Reference is now made to FIG. 8 which shows a fragmentary enlarged cross-sectional view of the waveguide-to-coax transition that is used in connection with each of the connector members. In this regard, refer to FIGS. 2 and 4, for example, which illustrate this transition in a less detailed manner. In FIG. 8 the transition is illustrated while FIGS. 9A–9D illustrate further specific details of the transition.

FIGS. 8 and 9A–9D show the waveguide 60 which is adapted at the left end in FIG. 8 to mate with a like waveguide section such as illustrated in FIG. 4 when the connector is completely assembled. FIG. 8, being a fragmentary view does not illustrate the end of the waveguide section. The opposite end of the waveguide may be machined to receive the coaxial line 62. The coaxial line 62 includes a center conductor 64 and an outer conductor 65; these conductors being separated by a dielectric insulator 66. The outer conductor 65 is suitably positioned within the waveguide and is in intimate electrical contact with the waveguide wide walls. In this regard, refer to FIG. 9D.

FIG. 8 along with FIGS. 9A–9D also illustrate the waveguide-to-coax transition 68 which basically comprises a transition from waveguide to antipodal finline shown at 69 in FIG. 8 with the antipodal finline structure transitioning to a microstrip circuit illustrated at 70 in FIG. 8 and thence to the coaxial cable 62.

The aforementioned waveguide-to-coax transition 68 is basically formed by means of an E-plane dielectric substrate 72 that is received by the waveguide 60. The cross-sectional views of FIGS. 9A–9D clearly illustrate the mode of support of the dielectric substrate 72. This substrate is electrically conductively supported at the walls of the waveguide and supports the antipodal finline structure which includes fin 74 on one side thereof and fin 76 on the other side thereof. Each of these fins are electrically conductive metal fins. The fin 74 has the configuration illustrated in solid in FIG. 8 while the fin 76 has the configuration illustrated in dotted in FIG. 8. Each of the fins is conductively coupled at the waveguide wall and the fin 74, as noted in FIG. 8, is connected to the center conductor 64 of the coax line. This connection of the center conductor to the fin may be carried out in a well-known manner such as by the use of soldering.

Figure 9A:
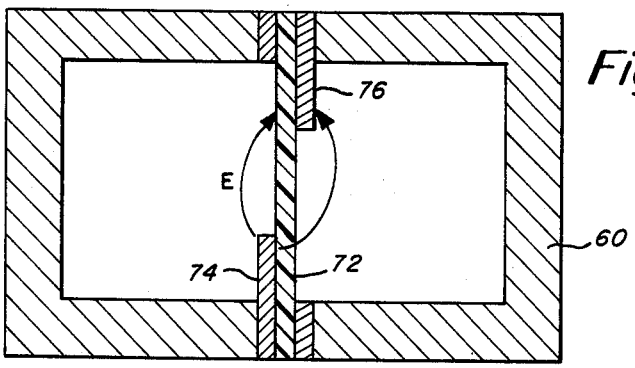
FIG. 9A is a cross-sectional view taken along line 9A—9A of FIG. 8 illustrating the antipodal finline structure and the E-field configuration before the fins start to overlap.
Figure 9B:
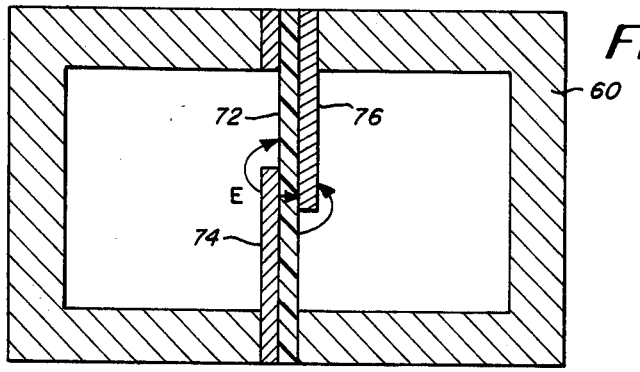
FIG. 9B illustrates a cross-sectional view taken along line 9B—9B of FIG. 8 also illustrating the antipodal finline structure and the E-field configuration in the area where the fins start to overlap.
Figure 9C:
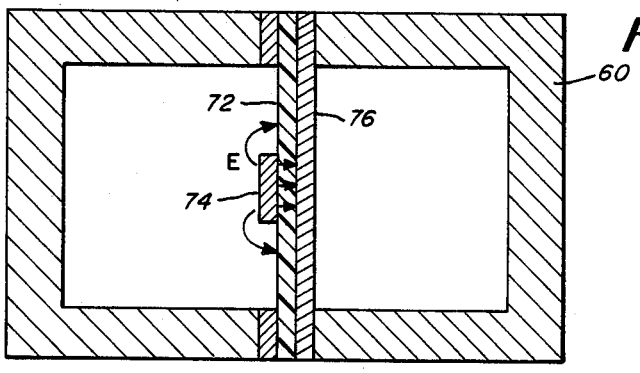
FIG. 9C illustrates a cross-sectional view taken along line 9C—9C of FIG. 8 showing the cross-section of the microstrip line and the associated E-field configuration.
Figure 9D:
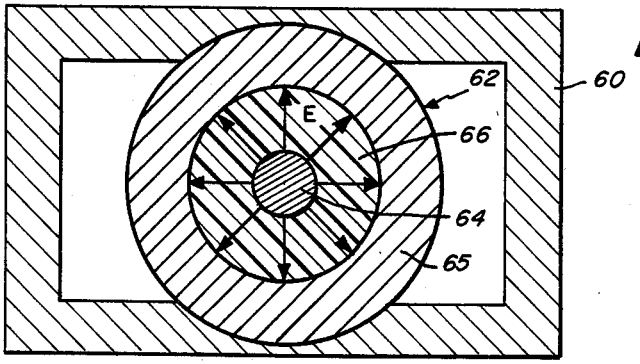
FIG. 9D illustrates a cross-sectional view taken along line 9D—9D of FIG. 8 showing the coaxial cable and the E-field configuration.

The cross-sectional view of FIG. 9A shows the antipodal finline structure and the associated E-field configuration. This particular cross-sectional view is taken at a point before the fins start to overlap. Note that the E-field configuration is substantially circular. The cross-sectional view of FIG. 9B illustrates the antipodal finline structure and the E-field configuration as the fins 74 and 76 start to overlap. Note the overlapping region at the very center of the waveguide in FIG. 9B. Also note the configuration of the E-field. FIG. 9C illustrates a further cross-section through the structure at the microstrip line section. It is noted at this cross-sectional view that the fin 76 extends across the waveguide. On the other hand, fin 74 is converging to the coax center conductor. Finally, in the cross-sectional view of FIG. 9D is shown the coaxial cable and the associated E-field configuration.

It is noted with the concepts of the present invention that substantial improved operation is provided, particularly in comparison with the previously used SSMA connector. In accordance with the invention, operation is now capable at much higher frequencies up to possibly as high as 140 GHz. The concepts of the present invention eliminate the need for the normal male-to-female center pin used with present coaxial connections such as the SSMA connector.

It is also noted that the waveguide alignment that is required in accordance with the present invention is substantially less critical than the fragile coaxial center conductor mating that is required in connection with the present SSMA type connector. Furthermore, with the use of the finline transition that is employed, a broadband operation is possible and there is provided a mechanically stable connector for use with the miniature cable required at millimeter frequencies.

It is to be noted that, of course, as the frequency of operation is increased, the waveguide becomes every bit as small as a coaxial cable. Therefore, the retaining nut that is used to hold the connector members together can also be made quite small. In this connection refer to the retaining nut 29 in the embodiment of FIGS. 1–3.

It is noted, as has been pointed out hereinbefore, that the use of the waveguide and the alignment thereof between the different members has several advantages, particularly in comparison with mechanical alignment associated with SSMA type connectors. The waveguide alignment tolerates some amount of misalignment without radically affecting operation. Second, it is easier to construct hermetic seals and yield better performance, eliminating the fragile center conductors and thus being less vulnerable to damage. Third, the waveguide has higher power handling capability.

A further advantage of the present invention is realized, in particular, in the embodiment of the invention illustrated in FIG. 4, wherein the connector members are substantially identical. This greatly simplifies the connector and eliminates the need for the male-to-female relationship normally required in coaxial connectors.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A coaxial connector comprising:

a first member including means at an outer side thereof for receiving a first transmission line means, means at an inner side thereof defining a section of waveguide, and coax-to-microtstip-to-antipodal-finline-to-waveguide transition means disposed intermediate said first transmission line means and said section of waveguide;

a second member including means at an outer side thereof for receiving a second transmission line means, means at an inner side thereof defining a section of waveguide, and coax-to-microstrip-to-antipodal-finline-to-waveguide transition means disposed intermediate said second transmission line means and said second member section of waveguide;

and means for supporting the first and second members with the inner sides thereof in facing relationship including means for holding the sections of waveguide of said first and second members, respectively, in alignment.

2. A coaxial connector comprising:

a first member including means at an outer side thereof for receiving a first transmission line means, means at an inner side thereof defining a section of waveguide, and coax-to-waveguide transition means comprising an E-plane substrate having an etched circuit for providing a first transition from waveguide-to-antipodal-finline disposed intermediate said first transmission line means and said section of waveguide;

a second member including means at an outer side thereof for receiving a second transmission line means, means at an inner side thereof defining a section of waveguide, and coax-to-waveguide transition means comprising an E-plane substrate having an etched circuit for providing a first transition from waveguide-to-antipodal-finline disposed intermediate said second transmission line means and said second member section of waveguide;

and means for supporting the first and second members with the inner sides thereof in facing relationship including means for holding the sections of waveguide of said first and second members, respectively, in alignment.

3. A coaxial connector as set forth in claim 1 or claim 2 wherein said transmission line means each comprise a coaxial line.

4. A coaxial connector as set forth in claim 1 or claim 2 wherein the section of waveguide of both first and second members comprises a rectangular waveguide.

5. A coaxial connector as set forth in claim 4 wherein the rectangular waveguide is dielectrically filled.

6. A coaxial connector as set forth in claim 1 or claim 2 wherein the sections of waveguide are each dielectrically filled.

7. A coaxial connector as set forth in claim 1 or claim 2 wherein the sections of waveguide are each double-ridged waveguide.

8. A coaxial connector as set forth in claim 2 including means defining a second transition from antipodal finline to coaxial cable.

9. A coaxial connector as set forth in claim 8 wherein said second transition includes a microstrip circuit.

10. A coaxial connector as set forth in claim 1 or claim 2 wherein said means for supporting comprises a retaining nut adapted to secure the first and second members together.

11. A coaxial connector as set forth in claim 10 wherein the means for holding in alignment comprises pin means associated with the members.

12. A coaxial connector as set forth in claim 1 or claim 2 wherein the means for holding in alignment comprises pin means associated with the members.

13. A coaxial connector comprising:

a first member including means at an outer side thereof for receiving a first transmission line means, means at an inner side thereof defining a section of waveguide, and first transmission line means-to-waveguide transition means comprising an E-plane substrate having a formed finline circuit means for providing a first transition from waveguide-to-finline-to-first transmission line means and disposed intermediate said first transmission line means and said section of waveguide;

a second member including means at an outer side thereof for receiving a second transmission line means, means at an inner side thereof defining a section of waveguide, and second transmission line means-to-waveguide transition means comprising an E-plane substrate having a formed finline circuit means for providing a first transition from waveguide-to-finline-to-second transmission line means and disposed intermediate said second transmission line means and said second member section of waveguide;

and means for supporting the first and second members with the inner sides thereof in facing relationship including means for holding the sections of waveguide of said first and second members, respectively, in alignment.

14. A coaxial connector as set forth in claim 13 wherein each member also includes a second transition means from finline circuit means-to-transmission line means.

15. A coaxial connector as set forth in claim 14 wherein said second transition means includes a microstrip circuit.

16. A coaxial connector as set forth in claim 13 wherein said means for supporting comprises a retaining nut adapted to secure the first and second members together.

17. A coaxial connector as set forth in claim 13 wherein the means for holding in alignment comprises pin means associated with the members.

* * * * *